US007204518B2

(12) United States Patent
Kubo et al.

(10) Patent No.: US 7,204,518 B2
(45) **Date of Patent: *Apr. 17, 2007**

(54) CONSTRUCTION MACHINE

(75) Inventors: Yoshiteru Kubo, Fukuoka (JP); Shinichi Senba, Saitama (JP); Jun Noguchi, Saitama (JP); Kouhei Urase, Shiga (JP); Takaharu Nishimura, Shiga (JP)

(73) Assignees: Komatsu Ltd., Tokyo (JP); Komatsu Zenoah Co., Kawagoe, Saitama (JP); Hitachi Construction Machinery Co., Ltd., Tokyo (JP)

( * ) Notice: Subject to any disclaimer, the term of this patent is extended or adjusted under 35 U.S.C. 154(b) by 343 days.

This patent is subject to a terminal disclaimer.

(21) Appl. No.: 10/848,388

(22) Filed: May 19, 2004

(65) Prior Publication Data

US 2004/0232687 A1 Nov. 25, 2004

(30) Foreign Application Priority Data

May 20, 2003 (JP) ..... 2003-142603
Apr. 1, 2004 (JP) ..... 2004-109074

(51) Int. Cl.
*B62D 24/00* (2006.01)

(52) U.S. Cl. ..... 280/781; 212/253; 180/9.1; 296/204

(58) Field of Classification Search ..... 280/781; 180/311, 9.1, 9.48, 6.12; 212/181, 175, 253; 384/591, 592, 593; 414/687; 296/204; 37/379
See application file for complete search history.

(56) References Cited

U.S. PATENT DOCUMENTS 4,341,276 A * 7/1982 Furuichi ..... 180/9.48
4,391,341 A * 7/1983 Taghon ..... 180/9.1
4,397,481 A * 8/1983 Dion et al. ..... 280/781

FOREIGN PATENT DOCUMENTS

| | | |
|---|---|---|
| JP | 62-59577 | 4/1987 |
| JP | 2560717 | 10/1997 |
| JP | 10-045059 | 2/1998 |
| JP | 10-236346 | 8/1998 |
| JP | 2001-003389 | 1/2001 |
| JP | 2002-138510 | 5/2002 |
| WO | WO 03/042022 A1 | 5/2003 |

* cited by examiner

*Primary Examiner*—Ruth Ilan
*Assistant Examiner*—Tiffany L Webb
(74) *Attorney, Agent, or Firm*—Posz Law Group, PLC; R. Eugene Varndell, Jr.

(57) ABSTRACT

A construction machine where a load acting on a vehicle body during an operation is transferred to ensure the strength of the vehicle body, thereby improving reliability including welding reliability. In the construction machine, at least one of the height differences between an upper face or a lower face of the center frame at a joining portion between the center frame and the connecting member and an upper face or a lower face of a center joining portion of the connecting member is set respectively at a dimension that is approximately equal to or less than the thickness of an upper face plate or a lower face plate of the center frame.

7 Claims, 9 Drawing Sheets

CONSTRUCTION MACHINE

BACKGROUND OF THE INVENTION

1. Field of the Invention

The present invention relates to a construction machine such as a hydraulic shovel, and more particularly to a frame constitution of a lower traveling body in a construction machine.

2. Description of the Related Art

As shown in the side view of FIG. 8, a conventional hydraulic shovel 11 comprises a lower traveling body 12 to enable movement, and an upper slewing body 13 which is mounted slewably onto the lower traveling body 12.

In the lower traveling body 12, a drive shaft 15 and a pivot 16 are attached respectively to the two end portions of a truck frame 14, and a crawler belt 17$^{i}$ is wrapped around the drive shaft 15 and pivot 16.

The hydraulic shovel 11 is driven by a power source engine, the power of which is converted into oil pressure by a hydraulic pump to drive a traction motor. This causes the drive shaft 15 to rotate, which drives the crawler belt 17 to rotate, and as a result, traveling is performed.

According to Japanese Patent Application 2002-332379, as shown in FIG. 9, in a frame 12F of the lower traveling body, sheet metal covers 21, 22 are welded to the upper face portion and lower face portion of a box-shaped rotary case 20 having an attachment ring 20*r* to which the upper slewing body 13 is attached slewably, and an inverse C-shaped case 23 formed from sheet metal is fixed to the two end portions thereof by welding. An upper face plate 24 is formed on the sheet metal inverse C-shaped case 23.

The truck frame of an axle-equipped vehicle is disclosed in Japanese Unexamined Patent Application Publication H10-236346.

Since the hydraulic shovel 11 described above performs operations outside, the crawler belt 17 is rotated to travel over various ground conditions, and hence the crawler belt 17 churns up earth, mud, and so on.

As shown in FIG. 8, the sheet metal cover 21 and upper face plate 24 disposed in the vicinity of the crawler belt 17 extend in a horizontal direction, and hence the earth, mud, and so on that is churned up by the crawler belt 17 accumulates on the upper face plates 24, 24.

Consequently, a worker must remove the accumulated earth, mud, and so on, and if the earth, mud, and so on are left to accumulate, they cause running resistance when the hydraulic shovel 11 is operated.

Measures such as opening a hole in the cover 21 may be considered so that the earth falls off the cover 21.

However, the cover 21 and the like invariably have a level part, and it is therefore difficult to solve the problem of earth accumulation.

To improve earth removal, a constitution has been considered in which the frame 12F of the lower traveling body is divided into the central box-shaped rotary case portion and the pair of truck frame portions on the opposite sides, and the truck frames are connected to the rotary case portion via a pair of leg-shaped connecting members.

According to this constitution, the rotary case portion and the truck frame portions are connected via a pair of connecting members, and hence an open space is formed between the pair of connecting members through which the earth that is churned up by the crawler belt 17 passes and falls to the ground. Thus earth removal can be precipitated favorably.

Conventionally, however, the truck frames 14, to which excessive loads may be applied, are connected to the rotary case 20 via the plate-form sheet metal covers 21, 22 which are single plates as shown in FIG. 9. Hence stress generated by a load acting on the truck frames 14 can be transmitted to the single plate covers 21, 22 extending in a planar direction, thus eliminating problems relating to strength.

In the case of the aforementioned constitution, on the other hand, the truck frame portions on which loads act and the central rotary case portion are connected via the connecting members which are constituted separately, and hence, depending on the connection configuration between the connecting members and the central rotary case portion, the vehicle body may break.

Therefore, the connection configuration between the connecting members and the rotary case portion needs to be considered to ensure that stress generated by a load transmitted from the truck frame portions to the connecting members is transferred appropriately from the connecting members to the central rotary case portion.

SUMMARY OF THE INVENTION

The present invention has been designed in consideration of this situation, and it is an object thereof to provide a construction machine in which a load acting on a vehicle body during an operation is transferred appropriately, thereby ensuring the strength of the vehicle body and improving reliability, and in which welding reliability can also be improved.

In a construction machine according to a first invention, a frame of a crawler-type traveling body comprises a box-shaped center frame, a pair of truck frames disposed on an outside of opposite side portions of said center frame, and a hollow connecting member for connecting said center frame to said truck frames, wherein at least one of respective height differences between an upper face or a lower face of said center frame at a joining portion between said center frame and said connecting member and an upper face or a lower face of a center joining portion of said connecting member is set respectively at a dimension that is approximately equal to or less than a thickness of an upper face plate or a lower face plate of said center frame.

In a construction machine according to a second invention, pertaining to the first invention, at the joining portion between said center frame and said connecting member, the upper face of said center joining portion of said connecting member is disposed slightly upward or slightly downward of the upper face of said center frame, and the lower face of said center frame is disposed at the same height as the lower face of said center joining portion of said connecting member.

In a construction machine according to a third invention, pertaining to the first invention, at the joining portion between said center frame and said connecting member, the upper face of said center frame is disposed at the same height as the upper face of said center joining portion of said connecting member, and the lower face of said center joining portion of said connecting member is disposed slightly upward or slightly downward of the lower face of said center frame.

In a construction machine according to a fourth invention, pertaining to the first invention, at the joining portion between said center frame and said connecting member, the upper face of said center joining portion of said connecting member is disposed slightly upward or slightly downward of the upper face of said center frame, and the lower face of said center joining portion of said connecting member is disposed slightly upward or slightly downward of the lower face of said center frame.

In a construction machine according to a fifth invention, pertaining to the first invention, at the joining portion between said center frame and said connecting member, the upper face of said center frame is disposed at the same height as the upper face of said center joining portion of said connecting member, and the lower face of said center frame is disposed at the same height as the lower face of said center joining portion of said connecting member.

According to the constitutions of the first through fifth inventions, the stress of a load that is transmitted via the upper face plate of the connecting member is transferred smoothly and effectively to the upper face plate of the center frame, which has good rigidity, or the stress of a load that is transmitted via the lower face plate of the connecting member is transferred smoothly and effectively to the lower face plate of the center frame. As a result, the load-withstanding strength of the vehicle body is ensured, leading to an improvement in mechanical reliability.

When the upper face plate and lower face plate of the center frame are disposed respectively in the vicinity of the upper face plate and lower face plate of the connecting member, stepped portions are formed. Hence the operating position during welding is easy to aim for, and as a result, teaching can be performed accurately, thus facilitating the welding operation and improving the welding reliability.

A construction machine according to a sixth invention comprises an upper slewing body and a lower traveling body, a frame of said lower traveling body comprising a hollow center frame on which said upper slewing body is slewably mounted, having a side plate surrounding sides thereof, a pair of truck frames disposed on an outside of opposite side portions of said center frame, and a hollow connecting member for connecting said center frame to said truck frames, a center joining portion of said connecting member being welded to the side plate of said center frame, wherein an upper face of the center joining portion of said connecting member is disposed in the vicinity of and downward of an upper face of said center frame, and a lower face of the center joining portion of said connecting member is disposed in the vicinity of and upward of a lower face of said center frame, whereupon the center joining portion of said connecting member is welded to the side plate of said center frame.

According to this constitution, the upper face of the center joining portion on the connecting member is disposed in the vicinity of and downward of the upper face of the center frame, and the lower face of the center joining portion on the connecting member is disposed in the vicinity of and upward of the lower face of the center frame, and as a result, a step is formed between the upper face of the center joining portion on the connecting member and the upper face of the center frame, and a step is formed between the lower face of the center joining portion on the connecting member and the lower face of the center frame. Hence the operating position during welding is easy to aim for, and as a result, teaching can be performed accurately, thus facilitating the welding operation and improving the welding reliability.

Further, the upper face plate of the center frame and the upper face plate of the connecting member are brought into proximity and welded, and the lower face plate of the center frame and the lower face plate of the connecting member are brought into proximity and welded, and hence the stress of a load that is transmitted via the upper face plate of the connecting member is transferred smoothly and effectively to the upper face plate of the center frame, which has good rigidity, or the stress of a load that is transmitted via the lower face plate of the connecting member is transferred smoothly and effectively to the lower face plate of the center frame. As a result, the load-withstanding strength of the vehicle body is ensured, leading to an improvement in mechanical reliability.

In a construction machine according to a seventh invention, pertaining to the sixth invention, the upper face of the center joining portion of said connecting member is disposed in the vicinity of and downward of the upper face of said center frame so as to form a step having an identical dimension to a height of a weld bead, and the lower face of the center joining portion of said connecting member is disposed in the vicinity of and upward of the lower face of said center frame so as to form a step having an identical dimension to a height of a weld bead, whereupon the center joining portion of said connecting member is welded to the side plate of said center frame.

According to this constitution, a step having an equal dimension to the height of a weld bead is provided upward of the center joining portion of the connecting member, and a step having an equal dimension to the height of a weld bead is provided downward of the center joining portion. Hence the operating position during robotic welding is easy to aim for, and as a result, teaching can be performed accurately, thus facilitating the welding operation and improving the welding reliability.

Further, since the step formed by the upper face of the center joining portion of the connecting member and the upper face of the center frame has an equal dimension to the height of the weld bead, and the step formed by the lower face of the center joining portion and the lower face of the center frame has an equal dimension to the height of the weld bead, the upper face plate of the connecting member and the upper face plate of the center frame can be welded in extremely close proximity, and the lower face plate of the connecting member and the lower face plate of the center frame can be welded in extremely close proximity.

Hence the stress of a load that is transmitted via the upper face plate of the connecting member is transferred smoothly and effectively to the upper face plate of the center frame, which has good rigidity, or the stress of a load that is transmitted via the lower face plate of the connecting member is transferred smoothly and effectively to the lower face plate of the center frame. As a result, the load-withstanding strength of the vehicle body is ensured, leading to an improvement in mechanical reliability.

DESCRIPTION OF THE PREFERRED EMBODIMENTS

The present invention will be described in detail below on the basis of the drawings illustrating embodiments thereof.

Figure 1:
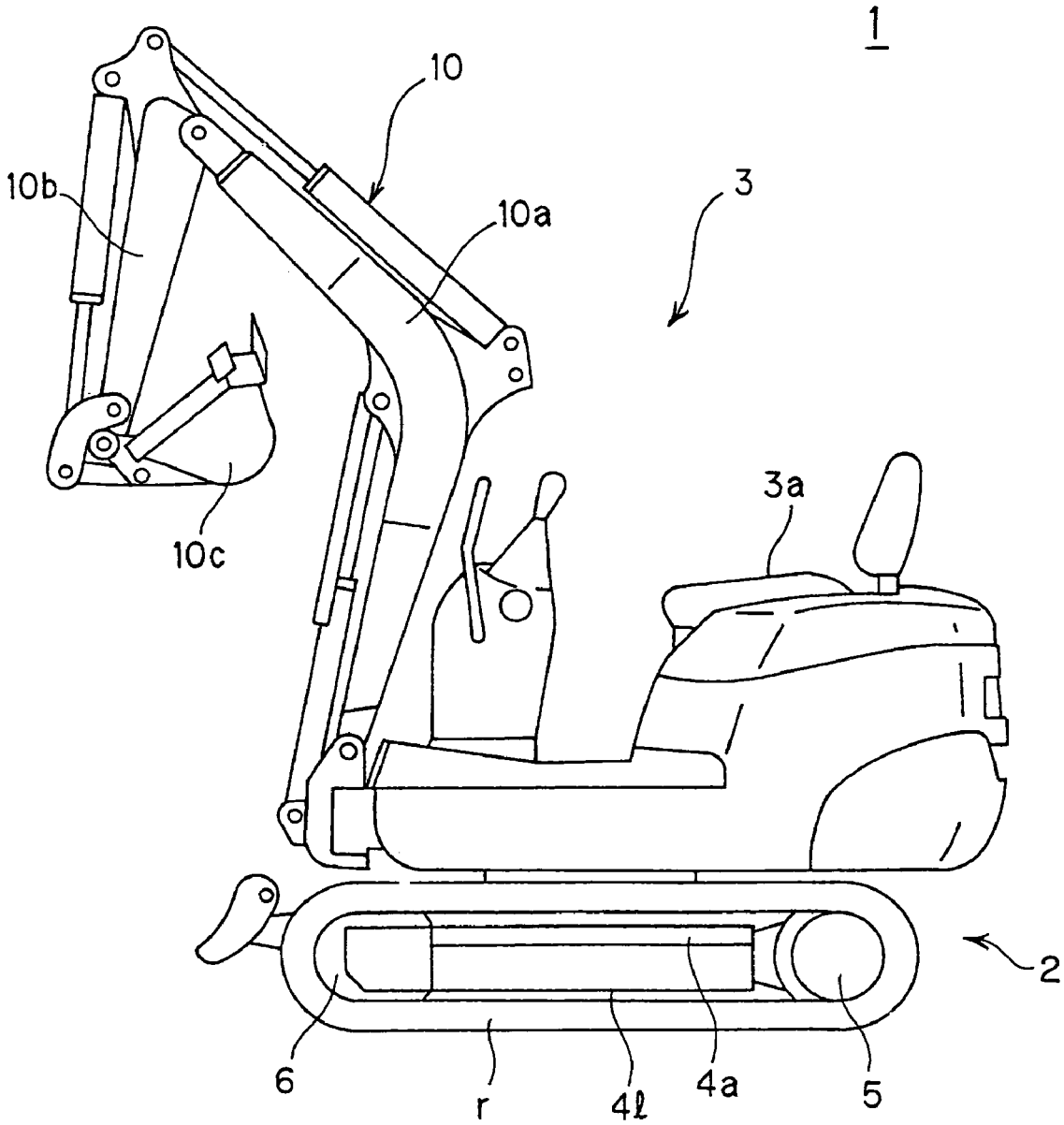
FIG. 1 is a side view showing a hydraulic shovel of an embodiment according to the present invention.

As shown in FIG. 1, a hydraulic shovel 1 according to this embodiment comprises a lower traveling body 2 to enable motion, and an upper slewing body 3 which is attached slewably to the top of the lower traveling body 2, and which is mounted by an operator to perform an operation.

An operating seat 3*a* on which the operator sits to perform an operation is provided on the upper slewing body 3, and a working machine 10 comprising a boom 10*a*, an arm 10*b*, and an excavating bucket 10*c* attached to the tip end of the arm 10*b*, which are hydraulically driven, is axially supported in a vertical direction so as to swing freely.

In the lower traveling body 2, a drive shaft 5 and a pivot 6 are attached respectively to the two end portions of truck frames 4*l*, 4*r*, and a crawler belt r is wrapped around the drive shaft 5 and pivot 6.

The hydraulic shovel 1 is driven by a power source engine, the power of which is converted into oil pressure by a hydraulic pump to drive a traction motor. The resultant power is transmitted to the drive shaft 5, causing the drive shaft 5 to rotate, which drives the crawler belt r to rotate, and as a result, traveling is performed.

Figure 2:
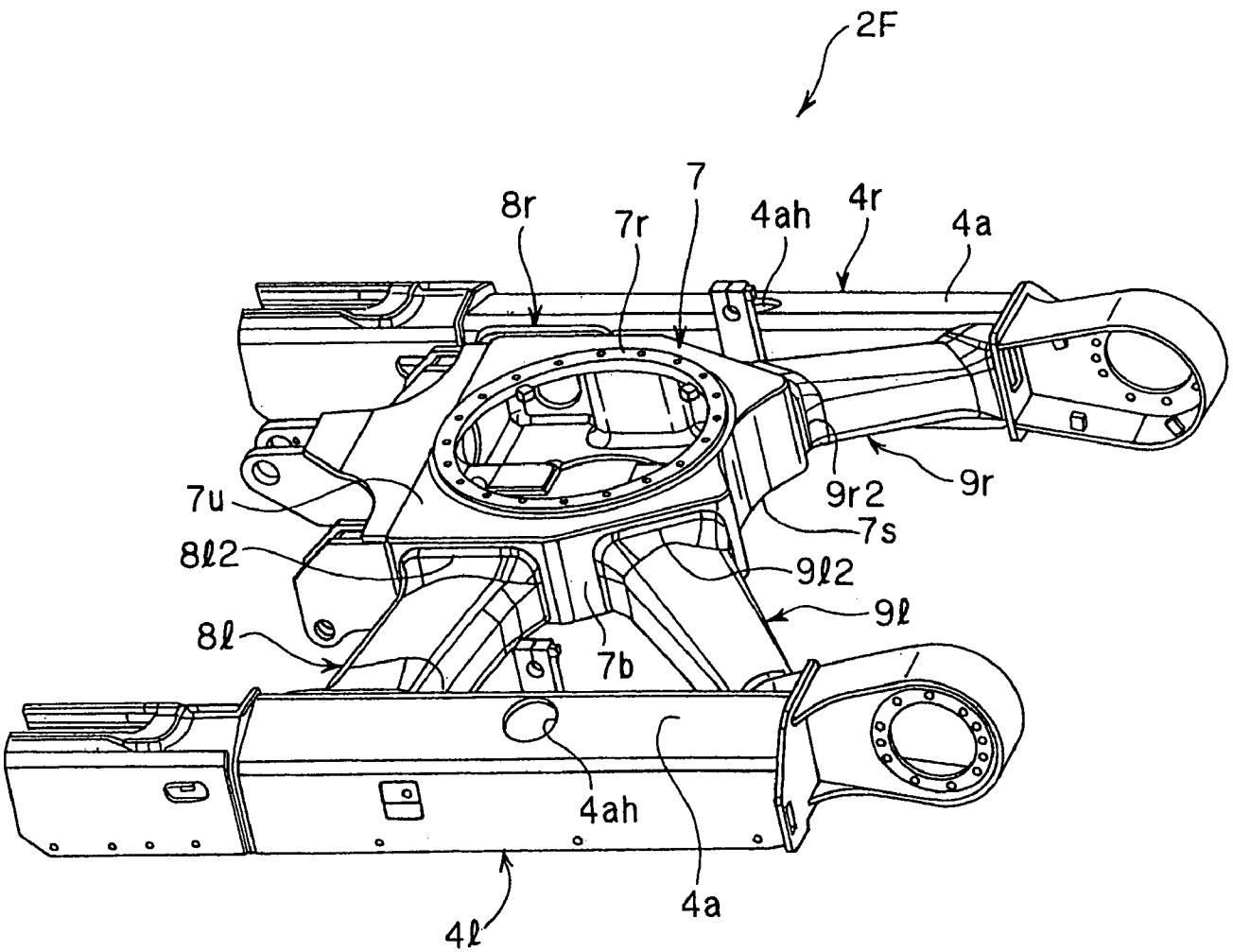
FIG. 2 is a perspective view of the frame of a lower traveling body in the hydraulic shovel of an embodiment according to the present invention.
Figure 3:
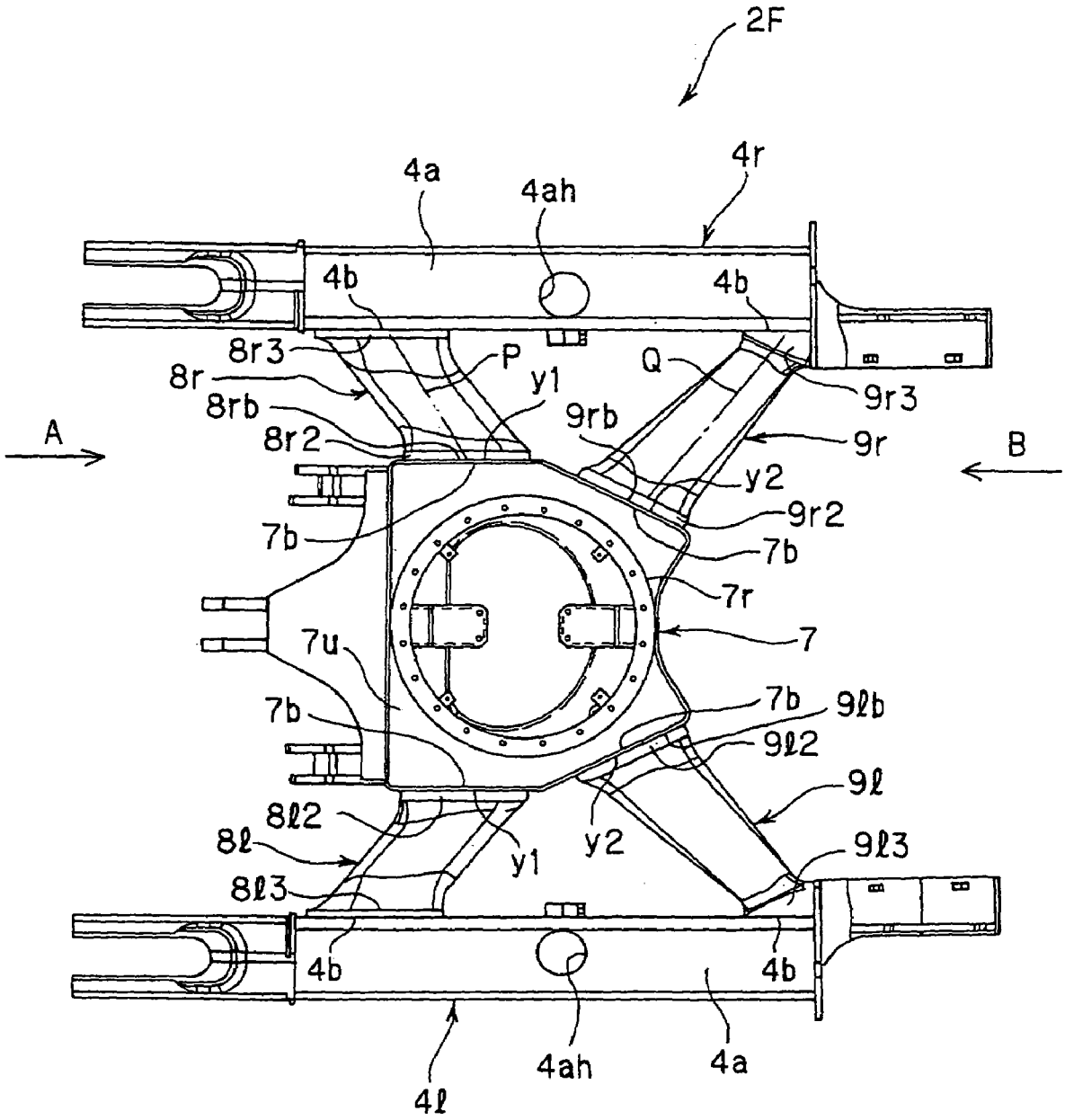
FIG. 3 is a top view of the frame of the lower traveling body in the hydraulic shovel of an embodiment according to the present invention.

As shown in the perspective view of FIG. 2 and the top view of FIG. 3, a center frame 7 comprising an attachment ring 7*r*, on which the upper slewing body 3 is mounted, is disposed in the central portion of a frame 2F of the lower traveling body, and the truck frames 4*r*, 4*l* are disposed on the opposite side portions thereof. The truck frame 4*r* is connected to the center frame 7 by two leg-shaped connecting members 8*r*, 9*r*, and the truck frame 4*l* is connected to the center frame 7 by two leg-shaped connecting members 8*l*, 9*l*.

These members are joined to each other by welding.

Note that as shown in FIG. 3, the truck frame 4*r* and the pair of connecting members 8*r*, 9*r*, and the truck frame 4*l* and the pair of connecting members 8*l*, 9*l* are constituted in plane symmetry about a central face (the center line of the vertical direction of the center frame 7 in FIG. 3) of the center frame 7 in the direction of width (the vertical direction in FIG. 3).

More specifically, in FIG. 3, the connecting member 8*r* and connecting member 8*l* take a symmetrical form about the central face of the center frame 7 in the direction of width, and the connecting member 9*r* and connecting member 9*l* take a symmetrical form about the central face of the center frame 7 in the direction of width.

Figure 4C:
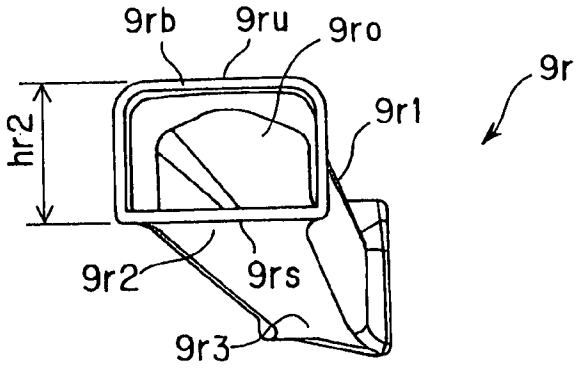
FIGS. 4A, 4B, and 4C are a perspective view showing a center frame of the hydraulic shovel of an embodiment according to the present invention, a perspective view showing a connecting member, and a perspective view showing a connecting member.
Figure 4B:
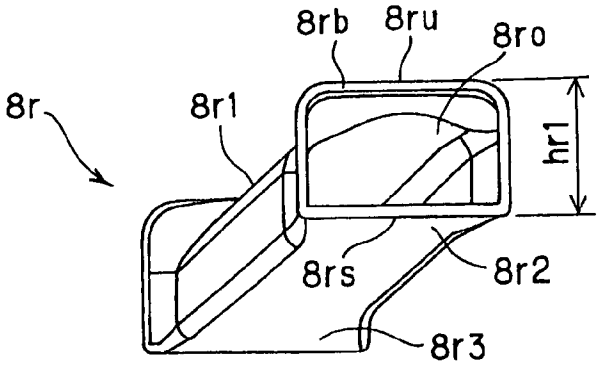
Figure 4A:
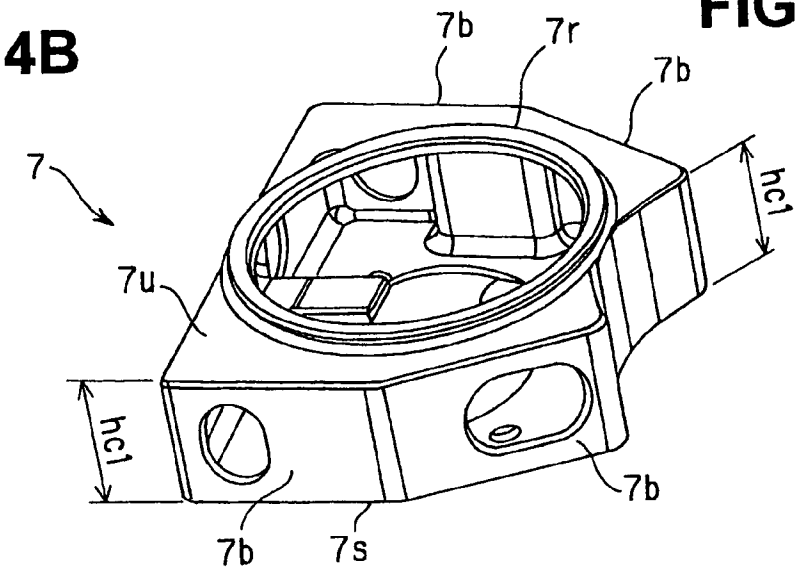

The center frame 7 is manufactured as a cast using cast steel, and as shown in FIG. 4A, is constituted in a hollow box form.

The attachment ring 7*r*, on which the upper slewing body 3 is mounted slewably, is formed on an upper face 7*u* of the center frame 7 with an opening in the central portion thereof, and a side plate 7*b* to which the connecting members 8*r*, 8*l*, 9*r*, 9*l* are welded so as to jut out radially from the attachment ring 7*r* is formed on the side face portion of the center frame 7.

Note that the side plate 7*b* is formed in a plate form having a vertical plane which is rectilinear when seen from above (see FIG. 3).

The connecting member 8*r* is manufactured as a cast using cast steel, and as shown in FIG. 4B (which is a perspective view of the connecting member 8*r* alone seen from the side of the center frame 7 shown in FIG. 3), is constituted in a hollow form comprising a core portion 8*r*1 formed with a ridge in the longitudinal direction of the upper face which has a substantially pentagonal cross section with an angled portion at the upper portion thereof, a center joining portion 8*r*2 having a quadrilateral cross section and formed with an opening 8*r*0, and a truck joining portion 8*r*3 formed with an opening.

In other words, the connecting member 8*r* is constituted as a pipe-form hollow member extending in a longitudinal direction having a closed transverse section.

The center joining portion 8*r*2 of the connecting member 8*r* comprises a joining face 8*rb* which is joined to the side plate 7*b* of the center frame 7, and as shown in FIG. 3, this joining face 8*rb* is formed in planar form to form a straight line when seen from above, and is thus non-perpendicular to the axis (the straight line P in FIG. 3) which runs along the direction in which the connecting member 8*r* extends.

Figure 5A:
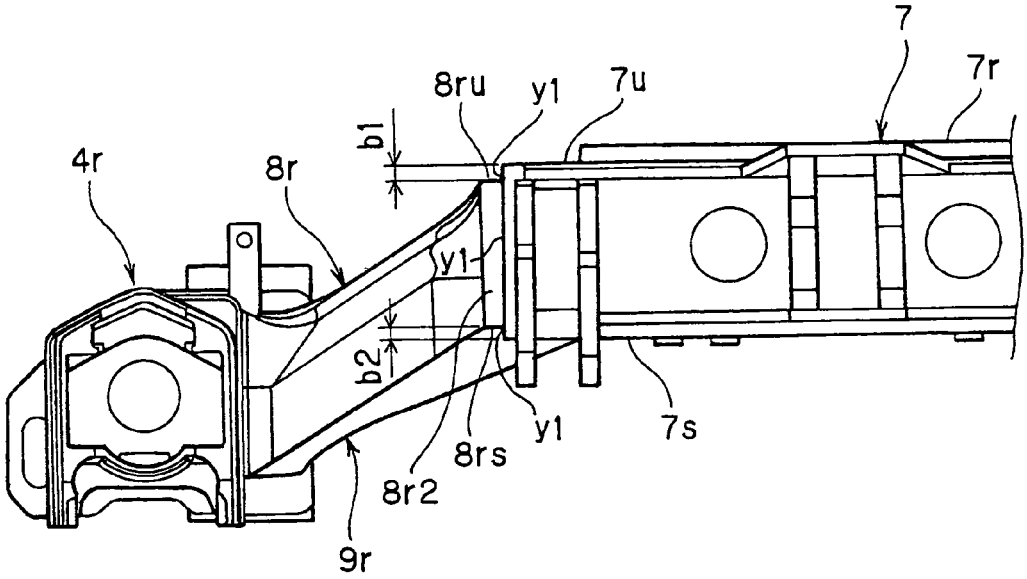
FIGS. 5A and 5B are a view seen from the direction of an arrow A and a view seen from the direction of an arrow B of the lower traveling body frame shown in FIG. 3.

Further, as shown in FIG. 4B, a height dimension hr1 between the upper face 8*ru* and a lower face 8*rs* of the center joining portion 8*r*2 having the joining face 8*rb* is set to be shorter than a height dimension hc1 (see FIG. 4) between an upper face 7*u* and a lower face 7*s* of the center frame 7 by identical dimensions b1, b2 to the height dimensions of the weld beads (see FIG. 5A, which is a view seen from the direction of the arrow A in FIG. 3).

In this manner, a welding configuration is employed in which slight steps b1, b2 are formed respectively between the upper and lower faces 7*u*, 7*s* of the center frame 7 and the upper and lower faces 8*ru*, 8*rs* of the center joining portion 8*r*2 on the connecting member 8*r* such that the upper face plate and lower face plate of the center frame 7 and the upper face plate and lower face plate of the connecting member 8*r* are connected in alignment with each other, and hence stress generated by a load transmitted via the upper face plate and lower face plate of the connecting member 8*r* is transferred smoothly to the upper face plate and lower face plate of the center frame 7.

As shown in FIGS. 3 and 5A, a welding location y1 between the joining face 8*rb* of the connecting member 8*r* and the side plate 7*b* of the center frame 7 is formed to be capable of taking a rectilinear form.

A truck joining portion 8*r*3 of the connecting member 8*r* is formed so as to match the joining face 4*b* (to be described below) of the truck frame 4 to enable welding to the joining face 4*b* of the truck frame 4.

The connecting member 8*l* shown in FIGS. 2, 3 is manufactured as a cast using cast steel, and as described above, is constituted in plane symmetry with the connecting member 8*r* about the central face of the center frame 7 in the direction of width. Similarly to the connecting member 8*r*, the connecting member 8*l* is formed as a hollow pipe-form member extending in a longitudinal direction having a closed transverse cross section.

As shown in FIG. 3, the connecting member 8*l* is welded to the center frame 7 in a similar configuration to the connecting member 8*r*, and hence detailed description thereof has been omitted.

The connecting member 9*r* is manufactured as a cast using cast steel, and as shown in FIG. 4C (which is a perspective view of the connecting member 9*r* alone seen from the center frame side in FIG. 3), is constituted in a hollow form comprising a tapered core portion 9*r*1 formed with a ridge in the longitudinal direction of the upper face which has a substantially pentagonal cross section with an angled portion at the upper portion thereof, a center joining portion 9*r*2 having a quadrilateral cross section and formed with an opening 9*r*0, and a truck joining portion 9*r*3 formed with an opening.

In other words, the connecting member 9*r* is constituted as a pipe-form, tapered hollow member extending in a longitudinal direction having a closed transverse section.

The center joining portion 9*r*2 of the connecting member 9*r* comprises a joining face 9*rb* which is joined to the side plate 7*b* of the center frame 7, and as shown in FIG. 3, this joining face 9*rb* is formed in planar form to form a straight line when seen from above, and is thus non-perpendicular to the axis (the straight line Q in FIG. 3) which runs along the direction in which the connecting member 9*r* extends.

Figure 5B:
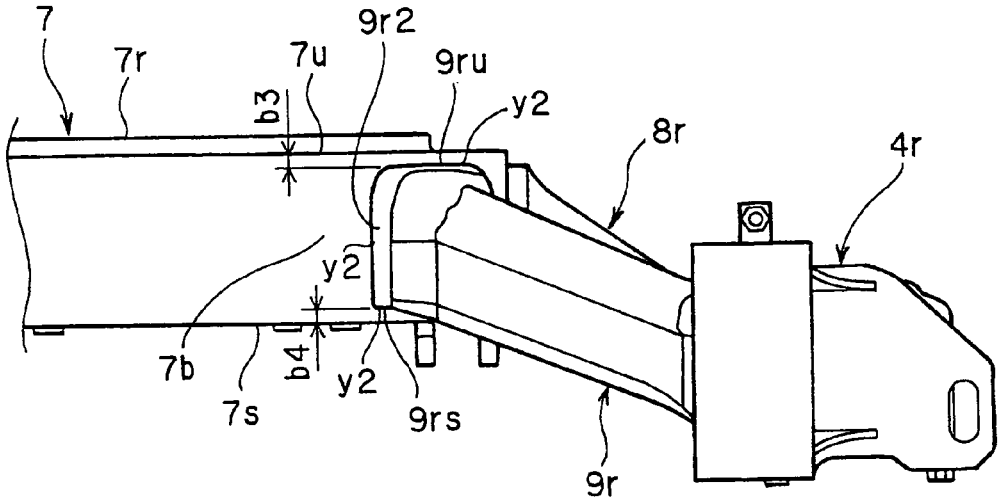

Further, as shown in FIG. 4C, a height dimension hr2 between an upper face 9*ru* and a lower face 9*rs* of the center joining portion 9*r*2 having the joining face 9*rb* is set to be shorter than a height dimension hc1 (see FIG. 4A) between the upper face 7*u* and lower face 7*s* of the center frame 7 by identical dimensions b3, b4 to the height dimensions of the weld beads (see FIG. 5B, which is a view seen from the direction of the arrow B in FIG. 3).

In this manner, a welding configuration is employed in which slight steps b3, b4 are formed respectively between the upper and lower faces 7*u*, 7*s* of the center frame 7 and the upper and lower faces 9*ru*, 9*rs* of the center joining portion 9*r*2 on the connecting member 9*r* such that the upper face plate and lower face plate of the center frame 7 and the upper face plate and lower face plate of the connecting member 9*r* are connected in alignment with each other, and hence stress generated by a load transmitted via the upper face plate and lower face plate of the connecting member 9*r* is transferred smoothly to the upper face plate and lower face plate of the center frame 7.

As shown in FIGS. 3 and 5B, a welding location y2 between the joining face 9*rb* of the connecting member 9*r* and the side plate 7*b* of the enter frame 7 is formed to be capable of taking a rectilinear form.

A truck joining portion 9*r*3 of the connecting member 9*r* is formed so as to match the joining face 4*b* (to be described below) of the truck frame 4 to enable welding to the joining face 4*b* of the truck frame 4.

The connecting member 9*l* shown in FIGS. 2, 3 is manufactured as a cast using cast steel, and as described above, is constituted in plane symmetry with the connecting member 9*r* about the central face of the center frame 7 in the direction of width. Similarly to the connecting member 9*r*, the connecting member 9*l* is formed as a tapered, hollow, pipe-form member extending in a longitudinal direction having a closed transverse cross section.

As shown in FIG. 3, the connecting member 9*l* is welded to the center frame 7 in a similar configuration to the connecting member 9*r*, and hence detailed description thereof has been omitted.

As described above, the connecting members 8*r*, 8*l*, 9*r*, 9*l* are constituted in a form having a ridge with an angled portion on the upper face thereof, and hence earth that is churned up by the crawler belt 9 during traveling slides down the inclined surface of the upper face of the connecting members 8 and falls to the ground, thus being prevented from accumulating on top of the connecting members 8.

The truck frames 4*r*, 4*l* extend in a front-rear direction (the left/right direction in FIGS. 1, 2, and 3) and have a quadrilateral cross section. As shown in FIG. 2, the upper face portion thereof is constituted with an inclined face plate 4*a* forming a singly tapered face which inclines downward toward the outside of the vehicle body. An earth removing hole 4*ah* is pierced through the inclined face plate 4*a* of the truck frames 4 near the center thereof.

Next, a method of joining the center frame 7 to the connecting members 8*r*, 8*l*, 9*r*, 9*l* will be described.

As shown in FIGS. 3 and 5A, when the center frame 7 is joined to the connecting member 8*r*, the center joining portion 8*r*2 of the connecting member 8*r* is disposed on the side plate 7*b* of the center frame 7 such that the upper face 8*ru* of the center joining portion 8*r*2 is positioned downward of the upper face 7*u* of the center frame 7 by the dimension b1, thus forming a step, and such that the lower face 8*rs* of the center joining portion 8*r*2 is positioned upward of the lower face 7*s* of the center frame 7 by the dimension b2, thus forming a step, whereupon robotic welding is performed at the welding location y1 between the side plate 7*b* of the center frame 7 and the center joining portion 8*r*2 of the connecting member 8*r*.

In so doing, a step having the dimension b1 is provided above the center joining portion 8*r*2 of the connecting member 8*r*, or in other words the welding location y1, and a step having the dimension b2 is provided below the center joining portion 8*r*2. Hence the operating position during robotic welding is easy to aim for, and as a result, teaching can be performed accurately.

As shown in FIGS. 2, 3, welding of the center frame 7 to the connecting member 8*l* is performed similarly to the welding described above between the center frame 7 and the connecting member 8*r*.

As shown in FIGS. 3 and 5B, when the center frame 7 is joined to the connecting member 9*r*, the center joining portion 9*r*2 of the connecting member 9*r* is disposed on the side plate 7*b* of the center frame 7 such that the upper face 9*ru* of the center joining portion 9*r*2 is positioned downward of the upper face 7*u* of the center frame 7 by the dimension b3, thus forming a step, and such that the lower face 9*rs* of the center joining portion 9*r*2 is positioned upward of the lower face 7*s* of the center frame 7 by the dimension b4, thus forming a step, whereupon welding is performed at the welding location y2 between the side plate 7*b* of the center frame 7 and the center joining portion 9*r*2 of the connecting member 9*r*.

In so doing, a step having the dimension b3 is provided above the center joining portion 9*r*2 of the connecting member 9*r*, or in other words the welding location y2, and a step having the dimension b4 is provided below the center joining portion 9*r*2. Hence the operating position during robotic welding is easy to aim for, and as a result, teaching can be performed accurately.

As shown in FIGS. 2, 3, welding of the center frame 7 to the connecting member 9*l* is performed similarly to the welding described above between the center frame 7 and the connecting member 9*r* by means of robotic welding at the welding location y2 around the joining face 9*lb* of the connecting member 9*l*.

Note that in this embodiment, an example was described in which the center frame 7 and connecting members 8*r*, 8*l*, 9*r*, 9*l* are manufactured as casts, but the center frame 7 and connecting members 8*r*, 8*l*, 9*r*, 9*l* are not limited to casts, and may be manufactured from sheet metal.

Also in this embodiment, the step dimensions b1, b2, b3, b4 are set to be equal to the dimensions of the weld beads, but may be set to different dimensions.

According to the constitution described above, the hydraulic shovel 1 travels over various ground surfaces, causing various loads to act on the truck frames 4*r*, 4*l* via the crawler belt r, and hence stress generated by these loads is transmitted to the connecting members 8*r*, 8*l*, 9*r*, 9*l* from the truck frames 4*r*, 4*l*. However, the upper and lower faces of the center joining portions 8*r*2, 8*l*2, 9*r*2, 9*l*2 of the connecting members 8*r*, 8*l*, 9*r*, 9*l* are connected to the upper and lower faces 7*u*, 7*s* of the center frame 7 with slight steps (b1, b2, b3, b4) therebetween, and hence the load stress that is transmitted via the upper face plate and lower face plate of the connecting members 8*r*, 8*l*, 9*r*, 9*l* is transferred smoothly and effectively to the upper face plate and lower face plate of the center frame 7, which extend in a horizontal direction and have good rigidity. As a result, the load-withstanding strength of the vehicle body is ensured, leading to an improvement in reliability.

Since steps are provided between the upper and lower faces 7*u*, 7*s* of the center frame 7 and the upper and lower faces of the center joining portions 8*r*2, 8*l*2, 9*r*2, 9*l*2 on the connecting members 8*r*, 8*l*, 9*r*, 9*l*, the operating positions during robotic welding are easy to aim for, enabling teaching to be performed easily and accurately, and thus leading to an improvement in welding reliability.

Next, first through fourth modified examples of the method for joining the center frame 7 to the connecting members 8*r*, 8*l*, 9*r*, 9*l* according to the above embodiment will be described.

Note that since the methods of joining the center frame 7 and the connecting members 8*l*, 9*r*, 9*l* are identical to the method of joining the center frame 7 and the connecting member 8*r*, only the method of joining the center frame 7 and the connecting member 8*r* will be described, omitting description of the other methods.

FIGS. 6A, 6B, 6C, and 6D are conceptual sectional views (sectional views seen from the A direction of FIG. 3) showing various joining states between a center frame 7*i* (71, 72, 73, 74) and the connecting member 8*r* (8*ra*, 8*rb*, 8*rc*, 8*rd*).

Figure 6C:
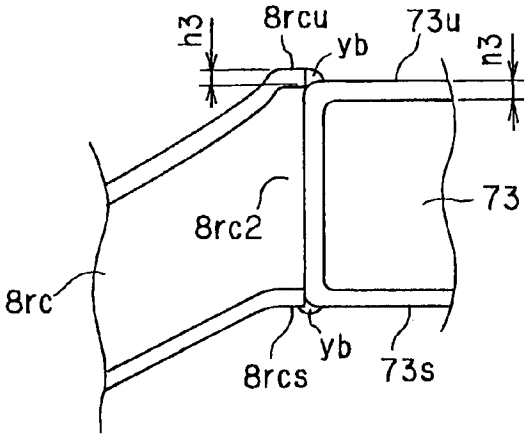
FIGS. 6A, 6B, 6C, and 6D are conceptual sectional views (sectional views seen from the A direction in FIG. 3) showing first through fourth modified examples of a method for joining the center frame to a connecting member 8*r* in an embodiment according to the present invention.
Figure 6A:
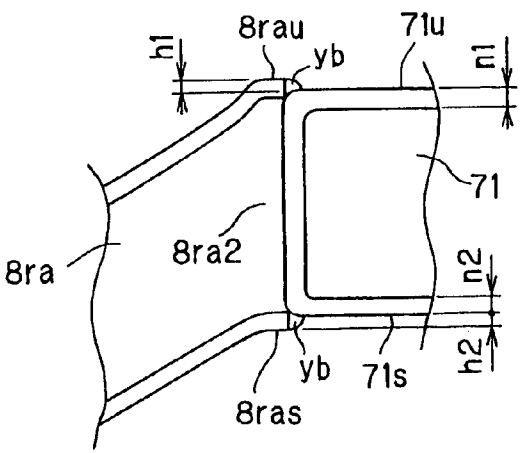

As shown in FIG. 6A, the first modified example is a case in which an upper face 8*rau* of a center joining portion 8*ra*2 on the connecting member 8*ra* is disposed upward of an upper face 71*u* of the center frame 71 by a dimension h1 (<≈n1) that is substantially identical to or less than the thickness n1 of the upper face plate of the center frame 71, and a lower face 8*ras* of the center joining portion 8*ra*2 on the connecting member 8*ra* is disposed downward of a lower face 71*s* of the center frame 71 by a dimension h2 (<≈n2) that is substantially identical to or less than the thickness n2 of the lower face plate of the center frame 71, whereupon the center frame 71 and connecting member 8*ra* are joined by welding via a weld bead yb.

Note that the upper face 8*rau* of the center joining portion 8*ra*2 on the connecting member 8*ra* may be disposed downward of the upper face 71*u* of the center frame 71 by the dimension h1 (<≈n1) that is substantially identical to or less than the thickness n1 of the upper face plate of the center frame 71, and the lower face 8*ras* of the center joining portion 8*ra*2 on the connecting member 8*ra* may be disposed upward of the lower face 71*s* of the center frame 71 by a dimension h2 (<≈n2) that is substantially identical to or less than the thickness n2 of the lower face plate of the center frame 71.

Figure 6D:
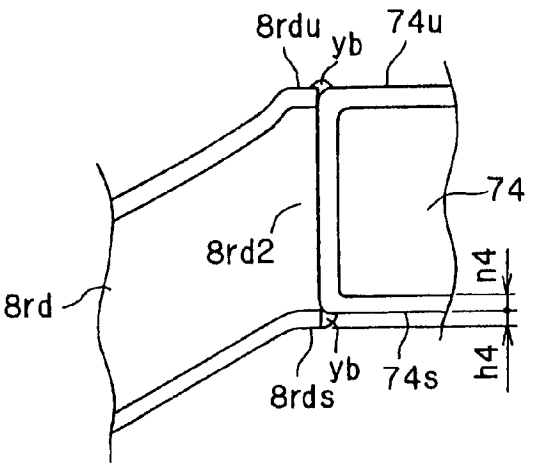
Figure 6B:
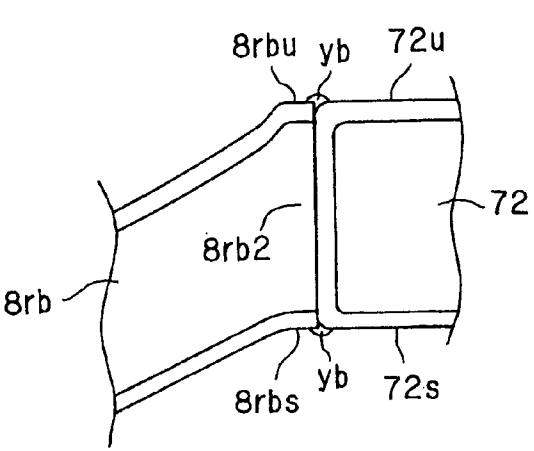

As shown in FIG. 6B, the second modified example is a case in which an upper face 8*rbu* of a center joining portion 8*rb*2 on the connecting member 8*rb* is disposed at the same height as an upper face 72*u* of the center frame 72, and a lower face 8*rbs* of the center joining portion 8*rb*2 on the connecting member 8*rb* is disposed at the same height as a lower face 72*s* of the center frame 72, whereupon the center frame 72 and connecting member 8*rb* are joined by welding via the weld bead yb.

As shown in FIG. 6C, the third modified example is a case in which an upper face 8*rcu* of a center joining portion 8*rc*2 on the connecting member 8*rc* is disposed upward of an upper face 73*u* of the center frame 73 by a dimension h3 (<≈n3) that is substantially identical to or less than the thickness n3 of the upper face plate of the center frame 73, and a lower face 8*rcs* of the center joining portion 8*rc*2 on the connecting member 8*rc* is disposed at the same height as a lower face 73*s* of the center frame 73, whereupon the center frame 73 and connecting member 8*rc* are joined by welding via the weld bead yb.

Note that as a variation of the third modified example, the upper face 8*rcu* of the center joining portion 8*rc*2 on the connecting member 8*rc* may be disposed and joined downward of the upper face 73*u* of the center frame 73 by the dimension h3 (<≈n3) that is substantially identical to or less than the thickness n3 of the upper face plate of the center frame 73.

As shown in FIG. 6D, the fourth modified example is a case in which an upper face 8*rdu* of a center joining portion 8*rd*2 on the connecting member 8*rd* is disposed at the same height as an upper face 74*u* of the center frame 74, and a lower face 8*rds* of the center joining portion 8*rd*2 on the connecting member 8*rd* is disposed downward of a lower face 74*s* of the center frame 74 by a dimension h4 (<≈n4) that is substantially identical to or less than the thickness n4 of the lower face plate of the center frame 74, whereupon the center frame 74 and connecting member 8*rd* are joined by welding via the weld bead yb.

Note that as a variation of the fourth modified example, the lower face 8*rds* of the center joining portion 8*rd*2 on the connecting member 8*rd* may be disposed and joined upward of the lower face 74*s* of the center frame 74 by the dimension h4 (<≈n4) that is substantially identical to or less than the thickness n4 of the lower face plate of the center frame 74.

According to the constitutions of the first through fourth modified examples, the upper face of the center joining portion on the connecting member is disposed near to the upper face of the center frame by a dimension that is approximately equal to or less than the thickness of the upper face plate of the center frame, or at the same height as the upper face of the center frame, and the lower face of the center joining portion on the connecting member is disposed near to the lower face of the center frame by a dimension that is approximately equal to or less than the thickness of the lower face plate of the center frame, or at the same height as the lower face of the center frame, whereupon the connecting member and center frame are joined. In so doing, stress that is transmitted to the center frame from the connecting members as the hydraulic shovel 1 travels is transferred smoothly to the upper face plate of the center frame from the upper face plate of the connecting member and to the lower face plate of the center frame from the lower face plate of the connecting member.

Note that when steps exist respectively between the upper face or the lower face of the center frame and the upper face or the lower face of the center joining portion of the connecting member, the weld bead yb connects the steps smoothly, and hence the aforementioned stress is transferred smoothly from the upper face plate or the lower face plate of the center joining portion on the connecting member via the weld bead yb to the upper face plate or the lower face plate of the center frame.

As a result, the load-withstanding strength of the vehicle body to loads transmitted from the connecting members is improved.

Further, when steps exist respectively between the upper face or the lower face of the center frame and the upper face or the lower face of the center joining portion of the connecting member, the operating position during robotic welding is easy to aim for, and as a result, teaching can be performed easily and accurately, leading to an improvement in welding reliability.

In the constitutions of the first through fourth modified examples, the aforementioned fixed effects are obtained when either of the relationship between the lower face of the center frame and the lower face of the center joining portion on the connecting member and the relationship between the upper face of the center frame and the upper face of the center joining portion on the connecting member is constituted as described in the first through fourth modified examples.

Figure 7:
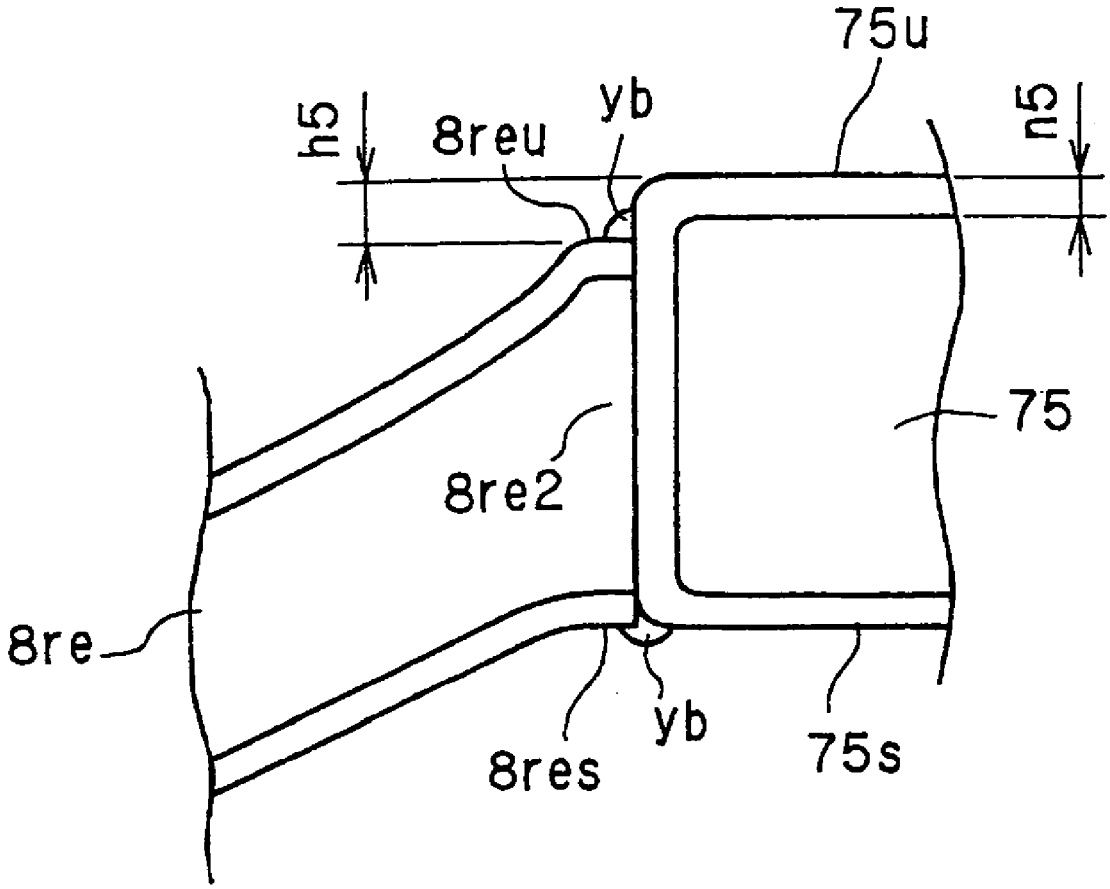
FIG. 7 is a conceptual sectional view (a sectional view seen from the A direction in FIG. 3) showing a fifth modified example of the method for joining the center frame to the connecting member in an embodiment according to the present invention.
Figure 8:
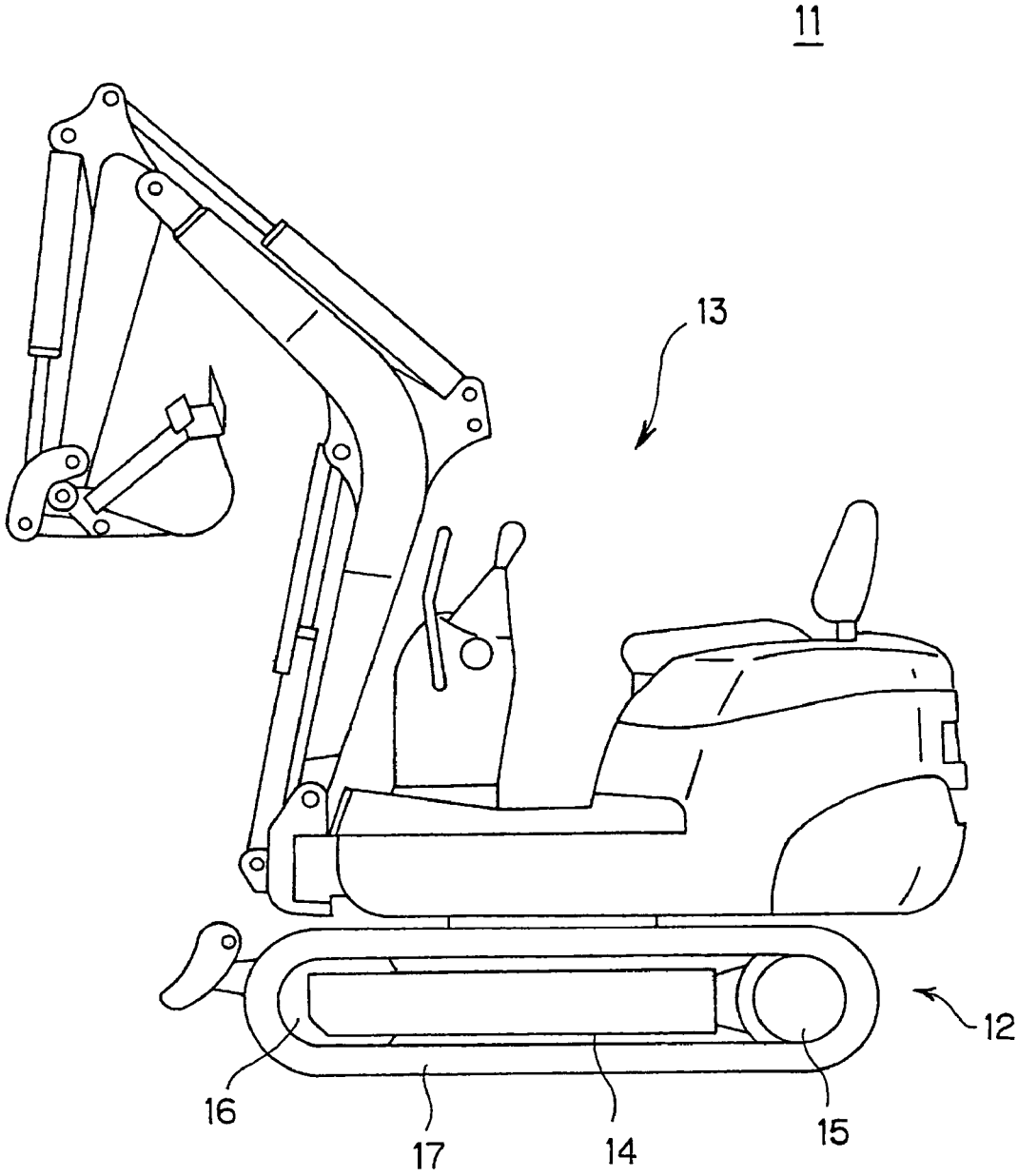
FIG.8 (PRIOR ART)
FIG. 8 is a side view showing a conventional hydraulic shovel.
Figure 9:
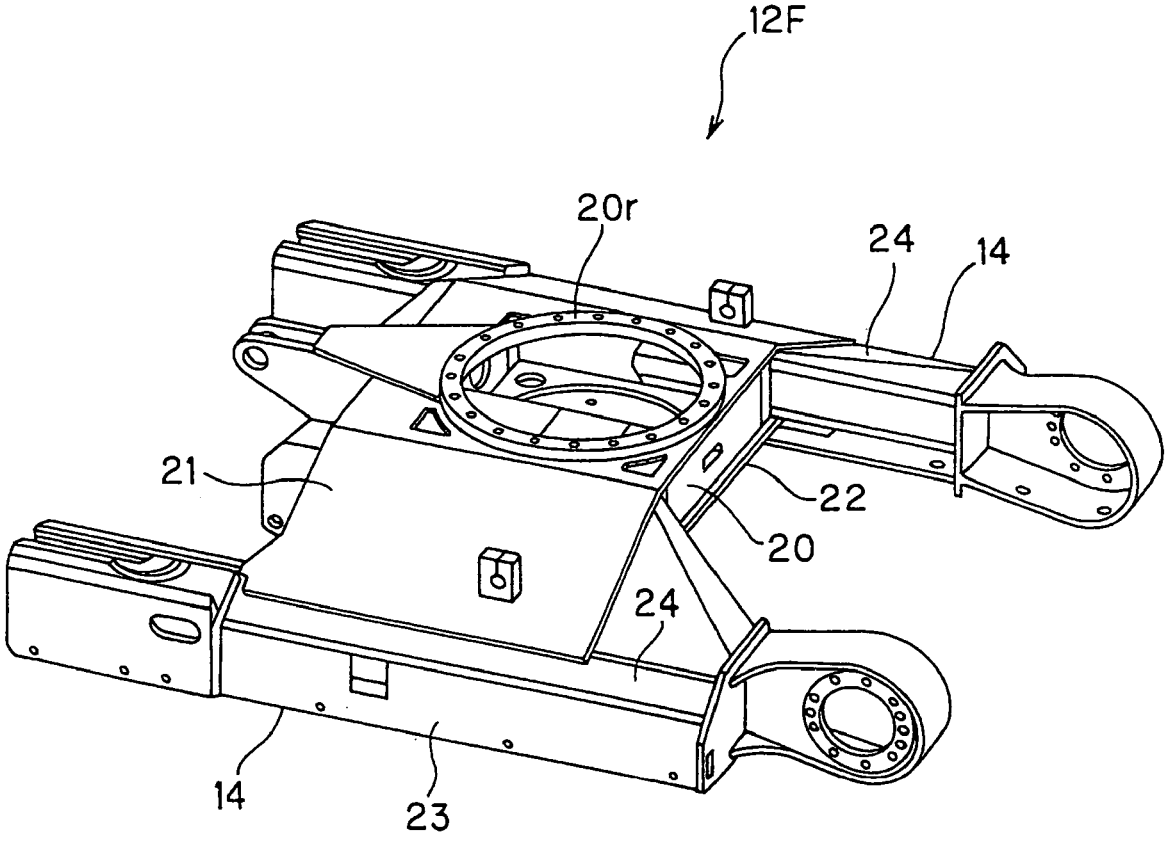
FIG.9 (PRIOR ART)
FIG. 9 is a perspective view of a lower traveling body frame of the conventional hydraulic shovel.

For example, as shown in FIG. 7, a lower face 8*res* of a center joining portion 8*re*2 on a connecting member 8*re* may be disposed at the same height as a lower face 75*s* of a center frame 75, and an upper face 8*reu* of the center joining portion 8*re*2 on the connecting member 8*re* may be disposed downward of an upper face 75*u* of the center frame 75 by a dimension h5 (>≈n5) that is substantially identical to or greater than the thickness n5 of the upper face plate of the center frame 75.

For example, the thickness n5 of the upper face plate of the center frame 75 may be set between 10 and 14 mm, and the step h5 between the upper face 75*u* of the center frame 75 and the upper face 8*reu* of the center joining portion 8*re*2 on the connecting member 8*re* may be set at 15 mm.

In this case, stress transmitted to the center frame 75 from the connecting member 8*re* is transferred smoothly from the lower face plate of the connecting member 8*re* to the lower face plate of the center frame 75, and moreover, irregularities in the vertical width dimension of the center frame 75 and the vertical width dimension of the connecting member 8*re* occurring during manufacture can be absorbed by the step h5 between the upper face 75*u* of the center frame 75 and the upper face 8*reu* of the center joining portion 8*re*2 on the connecting member 8*re*.

As opposed to the case shown in FIG. 7, the upper face 8*reu* of the center joining portion 8*re*2 on the connecting member 8*re* may be disposed at the same height as the upper face 75*u* of the center frame 75, and the lower face 8*res* of the center joining portion 8*re*2 on the connecting member 8*re* may be disposed upward of the lower face 75*s* of the center frame 75 by a dimension that is substantially identical to or greater than the thickness of the lower face plate of the center frame 75.

In this case, stress transmitted to the center frame 75 from the connecting member 8*re* is transferred smoothly from the upper face plate of the connecting member 8*re* to the upper face plate of the center frame 75, and moreover, irregularities in the vertical width dimension of the center frame 75 and the vertical width dimension of the connecting member 8*re* occurring during manufacture can be absorbed by the step between the lower face 75*s* of the center frame 75 and the lower face 8*res* of the center joining portion 8*re*2 on the connecting member 8*re*.

Note that in the embodiment and the first through fourth modified examples described above, an example was provided in which the center frame and connecting members are joined by welding, but a method other than welding, for example using bolts or the like, may be used to join the center frame and connecting members.

Note that in the embodiment described above, an example was provided in which a hydraulic shovel is used as the construction machine, but the construction machine according to the present invention may of course be applied effectively to a construction machine other than a hydraulic shovel having a similar constitution.

For example, the present invention may be applied effectively to a machine other than a hydraulic shovel which has a base carrier constitution, such as a crawler dump, a bulldozer, or an agricultural machine.

What is claimed is:

1. A construction machine in which a frame of a crawler-type traveling body comprises a box-shaped center frame, a pair of truck frames disposed on an outside of opposite side portions of said center frame, and a hollow connecting member for connecting said center frame to said truck frames, wherein at least one of respective height differences between an upper face or a lower face of said center frame at a joining portion between said center frame and said connecting member and an upper face or a lower face of a center joining portion of said connecting member is set respectively at a dimension that is approximately equal to or less than a thickness of an upper face plate or a lower face plate of said center frame, and the upper face plate of said center frame and the upper face plate of said center joining portion of said connecting member, or the lower face plate of said center frame and the lower face plate of said center joining portion of said connecting member, in which a height difference is set to the dimension, are formed in parallel to each other.

2. The construction machine according to claim 1, wherein, at the joining portion between said center frame and said connecting member, the upper face of said center joining portion of said connecting member is disposed slightly upward or slightly downward of the upper face of said center frame, and the lower face of said center frame is disposed at the same height as the lower face of said center joining portion of said connecting member.

3. The construction machine according to claim 1, wherein, at the joining portion between said center frame and said connecting member, the upper face of said center frame is disposed at the same height as the upper face of said center joining portion of said connecting member, and the lower face of said center joining portion of said connecting member is disposed slightly upward or slightly downward of the lower face of said center frame.

4. The construction machine according to claim 1, wherein, at the joining portion between said center frame and said connecting member, the upper face of said center joining portion of said connecting member is disposed slightly upward or slightly downward of the upper face of said center frame, and the lower face of said center joining portion of said connecting member is disposed slightly upward or slightly downward of the lower face of said center frame.

5. The construction machine according to claim 1, wherein, at the joining portion between said center frame and said connecting member, the upper face of said center frame is disposed at the same height as the upper face of said center joining portion of said connecting member, and the lower face of said center frame is disposed at the same height as the lower face of said center joining portion of said connecting member.

6. A construction machine comprising an upper slewing body and a lower traveling body, a frame of said lower traveling body comprising a hollow center frame on which said upper slewing body is slewably mounted, having a side plate surrounding sides thereof, a pair of truck frames disposed on an outside of opposite side portions of said center frame, and a hollow connecting member for connecting said center frame to said truck frames, a center joining portion of said connecting member being welded to the side plate of said center frame, wherein an upper face of the center joining portion of said connecting member is disposed in the vicinity of and downward of an upper face of said center frame, and a lower face of the center joining portion of said connecting member is disposed in the vicinity of and upward of a lower face of said center frame, whereupon the center joining portion of said connecting member is welded to the side plate of said center frame.

7. The construction machine according to claim 6, wherein the upper face of the center joining portion of said connecting member is disposed in the vicinity of and downward of the upper face of said center frame so as to form a step having an identical dimension to a height of a weld bead, and the lower face of the center joining portion of said connecting member is disposed in the vicinity of and upward of the lower face of said center frame so as to form a step having an identical dimension to a height of a weld bead, whereupon the center joining portion of said connecting member is welded to the side plate of said center frame.

* * * * *